United States Patent [19]

Haugsjaa et al.

[11] 3,943,403

[45] Mar. 9, 1976

[54] ELECTRODELESS LIGHT SOURCE UTILIZING A LAMP TERMINATION FIXTURE HAVING PARALLEL CAPACITIVE IMPEDANCE MATCHING CAPABILITY

[75] Inventors: Paul Osborne Haugsjaa, Acton; Robert James Regan, Needham; William Henry McNeill, Carlisle; Joseph Martin Lech, Westford, all of Mass.

[73] Assignee: GTE Laboratories Incorporated, Waltham, Mass.

[22] Filed: Apr. 21, 1975

[21] Appl. No.: 570,109

[52] U.S. Cl. ..... 315/39; 315/248

[51] Int. Cl.[2] ..... H01J 61/56

[58] Field of Search ..... 315/39, 248, 267, 344; 313/182

[56] References Cited

UNITED STATES PATENTS 3,787,705 1/1974 Bolin et al. ..... 315/248

*Primary Examiner*—R. V. Rolinec
*Assistant Examiner*—Darwin R. Hostetter
*Attorney, Agent, or Firm*—Irving M. Kriegsman; Leslie J. Hart

[57] ABSTRACT

A termination fixture for use in an electrodeless light source has an input impedance which is matched to the output impedance of a high frequency power source, even though the lamp which forms the termination for the fixture has a complex impedance when the lamp is in an excited state. The fixture has a pair of coaxial conductors of at least a quarter wavelength, the conductors being coupled to the source at one end and to the lamp at the other end. The conductors are shaped to create an impedance which matches the real component of the lamp impedance to the source impedance. A capacitor is formed across the inner and outer conductors at the source coupled end to compensate for the series capacitive reactance part of the lamp impedance at the lamp coupled end of the conductors.

13 Claims, 12 Drawing Figures

ELECTRODELESS LIGHT SOURCE UTILIZING A LAMP TERMINATION FIXTURE HAVING PARALLEL CAPACITIVE IMPEDANCE MATCHING CAPABILITY

BACKGROUND OF THE INVENTION

The present invention relates to electrodeless light sources and, more particularly, to such sources which are excited by high frequency power, such as in the range of 100 MHz to 300 GHz.

There have been, historically, three basic methods of exciting discharges without electrodes. The first method uses the discharge as a lossy part of either the capacitance or inductance of a "tank" circuit. This method is used to advantage only at frequencies where the dimensions of the lamp are much smaller than the wavelength of excitation. Also, in this method, there are power losses due to radiation and shifts in frequency upon start-up. A second method of exciting electrodeless lamps with microwave power is to place the lamp in the path of radiation from a directional antenna. However, since free propagation of microwave power occurs, there is an inherent inefficiency and some of the power is scattered, thereby endangering persons in the area.

A third method uses a resonant cavity which contains the lamp, a frequency tuning stub and a device for matching the lamp-cavity impedance to that of the source and transmission line. Examples of devices according to this method may be found in "Microwave Discharge Cavities Operating at 2450 MHz" by F. C. Fehsenfield et al., Review of Scientific Instruments, Volume 36, No. 3, (March, 1965). This publication describes several types of tunable cavities. In one type, cavity No. 5, the discharge cavity transfers power from the source to the lamp, and the resonant structure of the cavity increases the electric field in the gas of the lamp. The presence of a discharge in the resonator changes the resonant frequency and also changes the loaded Q factor. Therefore, it is necessary to provide both tuning (frequency) and matching (impedance) adjustments to obtain efficient operation over a wide range of discharge conditions. The tuning stub is first adjusted for a minimum reflected power with the minimum probe penetration. Next, the probe (impedance) is adjusted. Since these two operations are not independent, successive readjustments are required to achieve optimum efficiency.

All of these tunable cavities have features which make them less than ideally suited for use in an electrodeless light source. To make cavity type systems useful economically, the cavity must be small enough so that it would be feasible to use such systems in place of the conventional electrode containing lamp. Resonant cavities are too large and must be larger if lower microwave frequencies are used. One resonant cavity for 2450 MHz operation has four inches as its greatest dimension; the size would be even larger for operation at 915 MHz which is a standard microwave frequency for consumer use, such as with microwave ovens. Operation at this lower frequency is also advantageous from the view that the greater the frequency the more expensive the microwave power source becomes. The known tunable cavity has a less than optimum shape because the lamp is substantially enclosed by the resonant cavity housing, thereby impeding the transmission of light.

SUMMARY OF THE INVENTION

It is an object of the present invention to provide an improved electrodeless light source.

It is another object of the present invention to provide a termination fixture for an electrodeless lamp wherein the fixture impedance may be adjusted so that several different lamps may be run efficiently in a single fixture and any lamp may be run efficiently over a wide range of input power.

It is still another object of the present invention that the impedance matching be accomplished internally to the termination fixture by an adjusting element accessible from the exterior of the fixture.

According to the present invention, a source of high frequency power is coupled to a termination fixture which in turn couples high frequency power to an electrodeless lamp of the type having an envelope made of a light transmitting material and a fill material which emits light upon excitation. The termination fixture has an inner conductor and an outer conductor disposed around the inner conductor. The first ends of the conductors are coupled to the lamp so that the lamps forms a termination load for the fixture, and the second ends of the conductors are coupled to the source of high frequency power. The conductors have a length preferably of one quarter wavelength and have dimensions in cross-section such that the fixture characteristic impedance mathces the real component of the lamp impedance to the output impedance of the source (i.e., $Z_C = \sqrt{R_S \cdot R_L}$, where $R_S$ = source impedance and $R_L$ = real part of load impedance). The fixture further includes a reactive impedance matching device disposed in the region between the conductors preferably one quarter wavelength from the lamp for compensating for the reactive part of the lamp impedance. The device must have a reactance $X_M = R_S \cdot R_L / X_L$ where $X_L$ is the imaginary part of the load impedance. Thus, the input impedance of the fixture during lamp excitation is matched to the output impedance of the source. A higher impedance fixture can be used (i.e., $Z_C > \sqrt{R_S \cdot R_L}$); in this case a shorter fixture, less than a quarter wavelength, is required.

Usually, the reactive impedance of the lamp is capacitive, and the reactive impedance matching device is a capacitor since the quarter wavelength fixture converts the capacitive lamp impedance to an inductive impedance at that point. Several preferred types of capacitors may be used. Preferably, the capacitors are adjustable externally to the fixture so that a given fixture may be used to excite many types of lamps or any given lamp over a wide range of input power even though the lamp impedance varies with input power.

DESCRIPTION OF PREFERRED EMBODIMENTS

Figure 2:
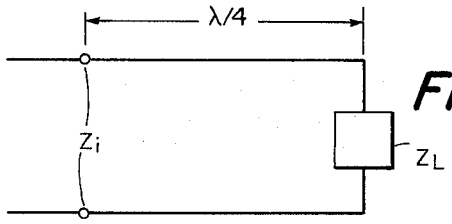
FIG. 2 is an equivalent circuit for the lamp and fixture when the lamp is excited.

One preferred range of frequencies is the industrial, scientific and medical (ISM) band ranging from 902 MHz to 928 MHz. The frequency which was found preferable within this ISM band is 915 MHz.

The lamp 14 has an envelope made of a light transmitting material, such as quartz, and a volatile fill material within the envelope, the fill material emitting light upon breakdown and excitation. Several known lamp compositions may be used, the following being examples.

EXAMPLE I

Fill Material
9.1 mg. of mercury
10 torr of argon
Envelope
Quartz sphere having a 15 mm. ID

EXAMPLE II

Fill Material
8.9 mg. of mercury
1.5 mg. of $ScI_3$
1.7 mg. NaI
20 torr of argon
Envelope
Quartz sphere having a 15 mm. ID

EXAMPLE III

Another contemplated fill material is 2 or 3 atoms of sodium for each mercury atom to yield under operating conditions 200 torr sodium partial pressure and about 1,000 torr mercury partial pressure. The envelope is a material which is resistant to sodium such as translucent $A1_2O_3$.

Figure 5:
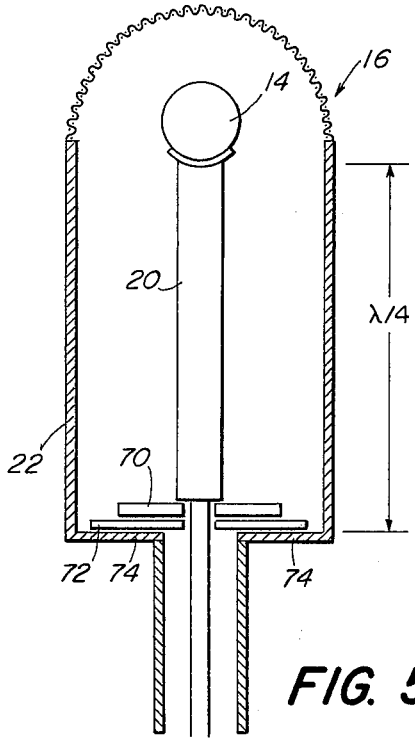
FIG. 5 is a partial sectional view of one embodiment of a termination fixture having a parallel, fixed value capacitor for impedance matching.

In accordance with the present invention, the termination fixture, such as in FIG. 5, includes an inner conductor 20 and an outer conductor 22 disposed around the inner conductor. The upper or first ends of these conductors are coupled to the lamp so that the lamp 14 forms the termination load for the fixture. The lower or second ends of the conductors are coupled to the source 12 such as with a connector, represented generally by the reference numeral 24. The conductors 20 and 22 have dimensions in length and cross-section such that the fixture 16 has an impedance which matches the real component of the complex impedance of the lamp during excitation to the output impedance of the source 12. In the preferred embodiments, these dimensions are a length of one quarter wavelength and cross-sections of circular, concentric shape whose diameters are determined by the following formula:

$$Z_C = \sqrt{R_S \cdot R_L} = \frac{138}{\sqrt{\epsilon_r/\mu_r}} \log \frac{b}{a}$$

where $Z_C$ = the characteristic impedance of the fixture
$R_S$ = the source impedance
$R_L$ = real part of the load impedance
$\epsilon_r$ = dielectric constant of the medium between the conductors
$\mu_r$ = permeability of the medium between the conductors
$b$ = inner diameter of the outer conductor
$a$ = diameter of the inner conductor However, it should be understood that other dimensions are possible which obtain the same result. The fixture 16 further includes a reactive impedance device in the region between the conductors near the lower end for compensating for the reactive part of the lamp complex impedance. By this device, the output impedance of the fixture 16 during the excited state of the lamp 14 is matched to the impedance of the coupled source 12.

FIGS. 5 through 12 illustrate various embodiments of the present invention in which the termination fixture provides complex impedance matching. The purpose of this invention is to provide better coupling to a wide variety of lamps when used with the same termination fixture. When, as is usually the case, the reactive impedance of the lamp is capacitive, the reactive impedance device at the input of the fixture consists of a small capacitor in parallel at the fixture input. This capacitor allows the fixture to be used for several lamps or for one lamp over a large range of input power.

Figure 3:
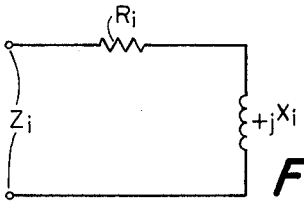
FIG. 3 is an equivalent circuit for the termination fixture at a location one quarter wavelength from the lamp.
Figure 4:
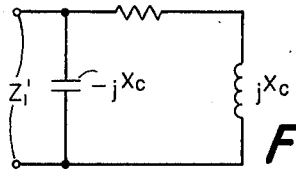
FIG. 4 is an equivalent circuit in which a parallel capacitor is used one quarter wavelength from the lamp to match the quarter wave transformed capacitive impedance of the lamp.
Figure 1:
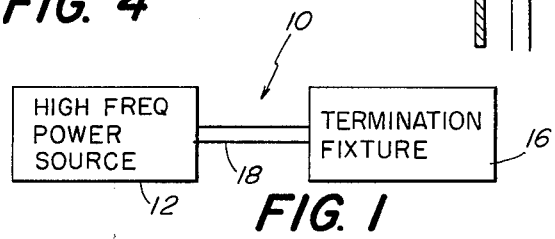
FIG. 1 is a block diagram of the light source in accordance with the present invention.

When a quarter wave termination fixture is used, the input impedance to the fixture is usually not the same as that of the characteristic impedance of the source 12 illustrated in FIG. 1. FIG. 2 illustrates basically the electrical circuit of the quarter wave termination fixture. The load, which is the lamp in the excited state, is termed $Z_L$ and equals $R_L - j\,X_L$, where $R_L$ is the arc resistance and $-j\,X_L$ is the net capacitive reactive impedance of the lamp. FIG. 3 is an equivalent circuit of the termination fixture as viewed from the input. The input impedance is $Z_i$ and is equal to $R_i + j\,X_i$, where $R_i$ is the real component of the fixture impedance which is equal to the characteristic impedance of the source and $j\,X_i$ is the inductive component of the fixture input impedance. This inductive component arises because the lamp impedance has a negative capacitive component and the quarter wave fixture transforms this component to a positive inductive value. As illustrated in FIG. 4, a parallel capacitor of an appropriate value at the input of the fixture cancels this inductive component. With the addition of this capacitive reactance ($-j\,X_c$) at the input in FIG. 4, the input impedance is as follows:

$$Z_i' = \frac{R_i X_c^2 - j\,X_c\,(R_i^2 + X_i^2 - X_i X_c)}{R_i^2 + (X_i - X_c)^2}$$

If $X_c = R_i^2/X_i + X_i$,
the input impedance will have only a real component.

At the high frequencies which are used in this light source, such as the ISM band of microwave frequencies, a very small capacitor of several picofarads provides sufficient capacitive reactance.

In FIG. 5, the capacitor comprises a conductive washer 70 which is disposed around the inner conductor 20 and a dielectric washer 72 disposed around the inner conductor 20 and between the conductive washer 70 and the outer conductor 22. Among the suitable materials which may be used as the dielectric wahser 72 are mylar, kapton, and mica. In FIG. 5, the conductive washer 70 has a fixed position and provides a constant capacitive reactance. The outer conductor 22 has a fixture end wall 74 connected thereto and the dielectric material forms an insulation between the conductive washer 70 and the fixture end wall 74. When it is desired to use this termination fixture for different types of lamps or the same lamp but at a different power range, different washers and thicknesses of dielectric materials are selected to effect a perfect impedance match.

Figure 6:
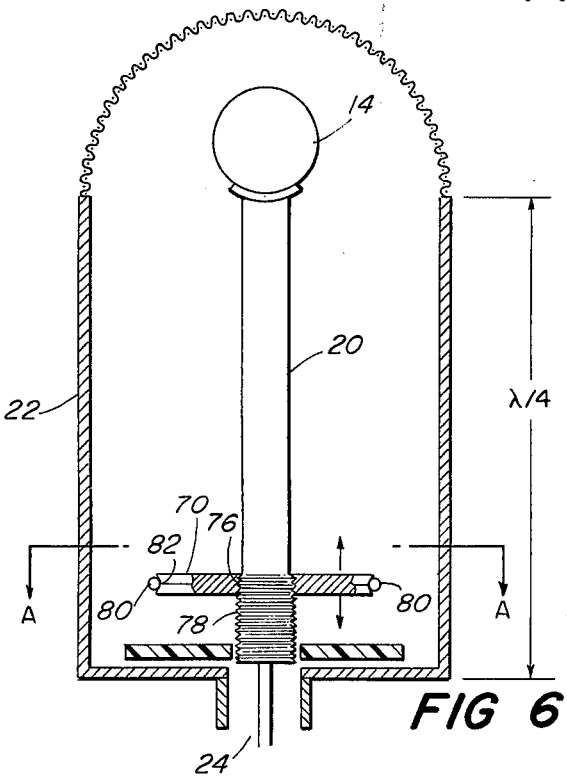
FIG. 6 is a partial sectional view of an alternative embodiment of a termination fixture in which the value of the capacitance is adjustable.
Figure 7:
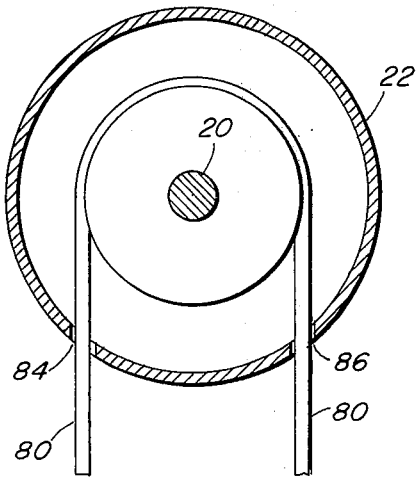
FIG. 7 is a sectional view of the embodiment in FIG. 6 taken along lines A—A.

FIGS. 6–12 illustrate another preferred form of this invention in which the capacitance is tunable so that an impedance match may be obtained for the fixture input impedance during various lamp operating conditions and for different types of electrodeless lamps. In FIGS. 6 to 9, the tuning device comprises forming internal threads 76 on the conductive washer 70 and matching external threads 78 on the inner conductor 20 so that the position of the washer along the length of the inner conductor 20 may be adjusted by rotating the conductive washer 70. The termination fixture also preferably includes a device which is suitable for rotating the washer 70 but being operable externally to the fixture. In FIGS. 6 and 7, this device includes a flexible element 80, such as a belt or cord, which is disposed in a concave portion 82 of the periphery of the conductive washer 70. The cord 80 extends through a pair of apertures 84 and 86 which are formed in the outer conductor 22 so that motion of the cord in the direction of arrows 90 produces rotation of the conductive washer 70.

Figure 8:
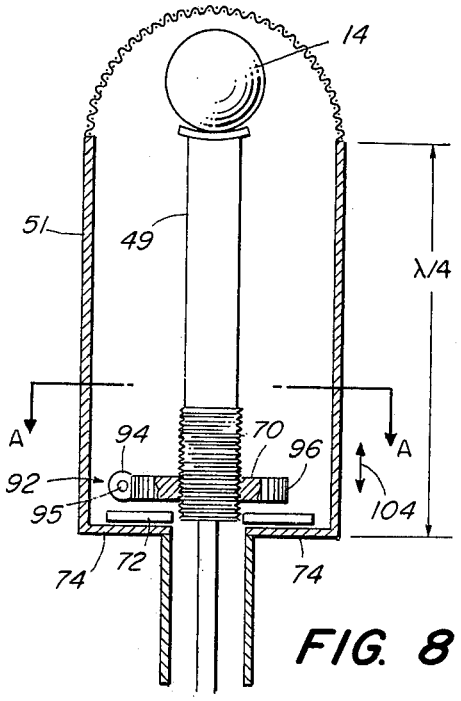
FIG. 8 is a partial sectional view of another alternative embodiment of a termination fixture.
Figure 9:
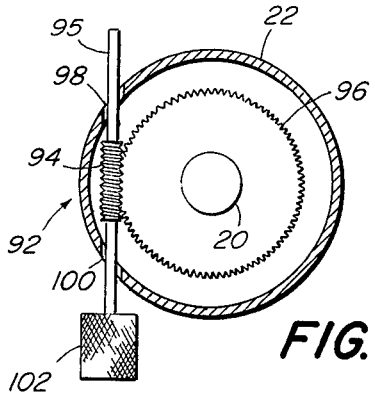
FIG. 9 is a plan view of the termination fixture in FIG. 8 with some portions removed.

FIGS. 8 and 9 illustrate an alternative embodiment of a device for rotating the conductive washer 70, this device being a gear assembly represented generally by the reference numeral 92. The gear assembly 92 may include a worm gear 94 which engages external threads 96 formed on the periphery of the conductive washer 70. The gear 94 is affixed to a shaft 95 which is disposed through a pair of apertures 98 and 100 in the outer conductor 22. The gear assembly may preferably include a tuning element 102 which when rotated about the shaft 95 causes a movement of the conductive element 70 in one direction of the arrows 104 in FIG. 8.

Figure 10:
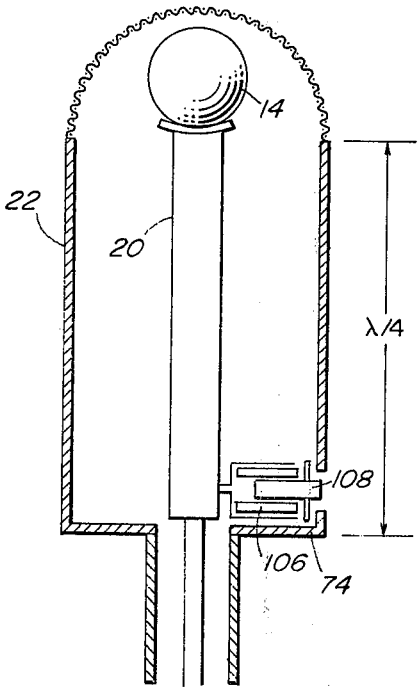
FIG. 10 is a partial sectional view of still another alternative embodiment of a termination fixture having an adjustable high Q capacitor.
Figure 12:
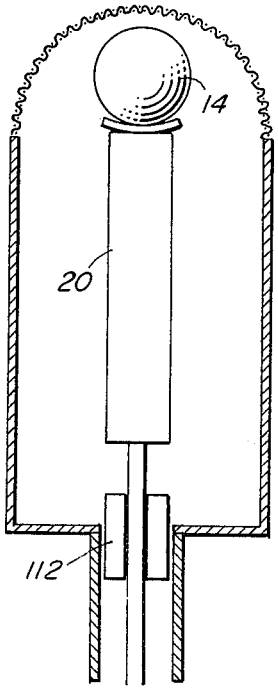
FIG. 12 is a partial sectional view of a further alternative embodiment of a termination fixture having an impedance matching capacitor.
Figure 11:
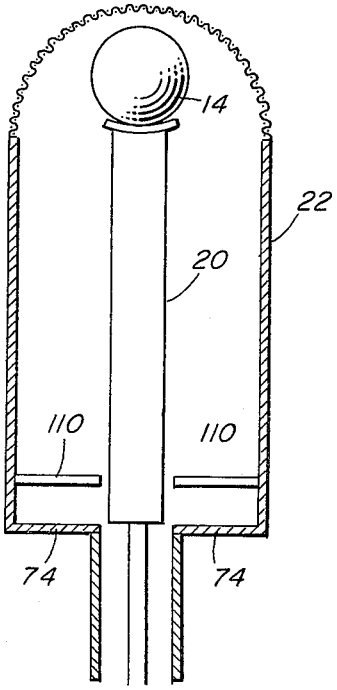
FIG. 11 is a partial sectional view of an additional alternative embodiment of a termination fixture having an adjustable iris.

Referring now to FIG. 10, the capacitive device may also include an externally tunable ceramic high Q capacitor 106. A tuning element 108 permits the capacitor 106 to be adjusted to the proper value. One suitable capacitor is Johanson No. 5202 (0.8 to 8 pFd). FIG. 11 illustrates another preferred embodiment in which the capacitive device includes an adjustable iris 110 between the inner and outer conductors 20 and 22, respectively. Also, as illustrated in FIG. 12, the capacitive device may also include a sliding washer 112 which can be moved axially and is disposed around the inner conductor 20. The washer 112 is preferably made of a high dielectric constant material.

The embodiments of the present invention are intended to be merely exemplary and those skilled in the art shall be able to make numerous variations and modifications to them without departing from the spirit of the present invention. All such variations and modifications are intended to be within the scope of the present invention as defined in the appended claims.

We claim:

1. A light source including:

a. a source of power at a high frequency, b. an electrodeless lamp having an envelope made of a light transmitting material and a volatile fill material within the envelope, the fill material emitting light upon breakdown and excitation, and c. a termination fixture coupled to the source, the fixture including an inner conductor and an outer conductor disposed around the inner conductor, the first ends of the conductors being coupled to the lamp so that the lamp forms a termination load for the fixture, the second ends of the conductors being coupled to the source, the conductors having dimensions in length and cross section such that the fixture impedance matches the real component of the complex impedance of the lamp during excitation to the output impedance of the source, the fixture further including a reactive impedance device disposed in the fixture in the region between the conductors near the second end for compensating for the reactive part of the lamp complex impedance, whereby the input impedance of the fixture during the excited state of the lamp is matched to the impedance of the coupled source.

2. The source according to claim 1 wherein the inner conductor has a length of one quarter wavelength.

3. The source according to claim 1 wherein the reactive impedance of the lamp is capacitive and the reactive impedance of the matching device is capacitive.

4. The source according to claim 3 wherein the capacitor comprises a fixed conductive plate disposed around the inner conductor and a fixed dielectric plate disposed around the inner conductor and between the conductive plate and the outer conductor.

5. The source according to claim 3 further including means for tuning the capacitance to match the fixture input impedance during various lamp operating conditions and for several different types of electrodeless lamps.

6. The source according to claim 5 wherein the capacitance includes a conductive plate disposed around the inner conductor and a dielectric plate disposed around the inner conductor and between the conductive plate and the outer conductor and wherein the tuning means includes forming internal threads on the conductive plate and matching external threads on the inner conductor so that the position of the plate along the length of the inner conductor may be adjusted by rotating the conductive plate.

7. The source according to claim 6 further including means operable externally to the fixture for rotating the plate.

8. The source according to claim 7 wherein the rotating means includes a flexible element disposed in a concave portion of the periphery of the conductive plate, the flexible element extending through a pair of apertures formed in the outer conductor so that motion of the flexible element produces a rotation of the conductive plate.

9. The source according to claim 7 wherein the rotating means includes a gear assembly.

10. The source according to claim 9 wherein the gear assembly includes a worm gear engaging external threads on the periphery of the conductive plate, the gear being affixed to a shaft disposed through a pair of apertures in the outer conductor.

11. The source according to claim 3 wherein the capacitive device includes an externally tunable, high Q capacitor connected directly between the inner and outer conductors.

12. The source according to claim 3 wherein the capacitor includes an adjustable iris between the inner and outer conductors.

13. The source according to claim 3 wherein the capacitive device includes a slidable washer which is adjustable to positions along the length of the inner conductor and is disposed around the inner conductor, the washer being made of a high dielectric constant material.

* * * * *

UNITED STATES PATENT OFFICE

CERTIFICATE OF CORRECTION

Patent No. 3,943,403 Dated March 9, 1976

Inventor(s) P. Haugsjaa/R. Regan/W.McNeill/J. Lech

It is certified that error appears in the above-identified patent and that said Letters Patent are hereby corrected as shown below:

Column 1, line 34, delete "Fehsenfield" and insert --Fehsenfeld--;
Column 2, line 24, delete "lamps" and insert --lamp--;
Column 5, line 12, delete "wahser" and insert --washer--;

Signed and Sealed this

[SEAL] eighth Day of June 1976

Attest:

RUTH C. MASON
Attesting Officer

C. MARSHALL DANN
Commissioner of Patents and Trademarks